US007635943B2

(12) United States Patent
Kamio et al.

(10) Patent No.: US 7,635,943 B2
(45) Date of Patent: Dec. 22, 2009

(54) IMAGE DISPLAY DEVICE HAVING AN ION PUMP WITH REDUCED LEAKAGE

(75) Inventors: Masaru Kamio, Kanagawa-Ken (JP); Ihachiro Gofuku, Kanagawa-Ken (JP); Hisanori Tsuda, Kanagawa-Ken (JP); Yasue Sato, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 220 days.

(21) Appl. No.: 11/205,062

(22) Filed: Aug. 17, 2005

(65) Prior Publication Data

US 2006/0043871 A1 Mar. 2, 2006

(30) Foreign Application Priority Data

Aug. 27, 2004 (JP) ..... 2004-248539

(51) Int. Cl.
*H01J 7/16* (2006.01)

(52) U.S. Cl. ..... 313/7; 313/553; 313/558; 313/161; 417/48; 417/49; 417/50; 417/51

(58) Field of Classification Search ..... 313/7, 313/495–496, 545–547, 549, 553, 560, 555, 313/365, 362.1, 153, 558, 161; 417/48–51
See application file for complete search history.

(56) References Cited

U.S. PATENT DOCUMENTS 3,994,625 A * 11/1976 Welch ..... 417/49
5,936,342 A 8/1999 Ono et al. ..... 313/495
6,198,214 B1 * 3/2001 Anandan et al. ..... 313/495
6,726,520 B2 4/2004 Takeda et al. ..... 445/62
6,827,621 B1 12/2004 Enomoto et al. ..... 445/24
6,846,213 B2 1/2005 Sato ..... 445/6
6,848,961 B2 2/2005 Nomura et al. ..... 445/24
7,091,662 B2 8/2006 Hasegawa et al. ..... 313/555
2002/0059977 A1 * 5/2002 Igeta ..... 156/182
2002/0076966 A1 * 6/2002 Carron et al. ..... 439/330
2003/0113120 A1 * 6/2003 Ohe et al. ..... 398/139
2003/0222570 A1 * 12/2003 Kishi et al. ..... 313/495
2005/0009433 A1 1/2005 Nomura et al. ..... 445/24
2006/0043865 A1 3/2006 Gofuku et al. ..... 313/362.1
2006/0043866 A1 3/2006 Tsuda et al. ..... 313/365
2006/0043870 A1 3/2006 Tsuda et al. ..... 313/495
2006/0049734 A1 3/2006 Sato et al. ..... 313/153
2006/0055637 A1 3/2006 Gofuku et al. ..... 345/75.2
2006/0078433 A1 * 4/2006 Seino et al. ..... 417/50

FOREIGN PATENT DOCUMENTS

JP 02097671 A * 4/1990

(Continued)

*Primary Examiner*—Joseph L Williams
*Assistant Examiner*—Fatima N Farokhrooz
(74) *Attorney, Agent, or Firm*—Fitzpatrick, Cella, Harper & Scinto

(57) ABSTRACT

An image display apparatus is provided with a vacuum chamber consisting of an electron source substrate and an image display substrate, and an ion pump which is attached to an electron-emitting substrate or the image display substrate and exhausts air from the vacuum chamber by the action of a magnet, wherein the magnet is attached and fixed to the substrate to which the ion pump has been attached. Thereby, the image display apparatus prevents the magnet from applying an excessive force to the ion pump by its weight, and acquires a stable structure without causing a vacuum leak.

3 Claims, 6 Drawing Sheets

FOREIGN PATENT DOCUMENTS

| | | | |
|---|---|---|---|
| JP | 5-121012 | | 5/1993 |
| JP | 08022803 | * | 1/1996 |
| JP | 8022803 | * | 1/1996 |
| JP | 9-82245 | | 3/1997 |
| JP | 2000-133136 | | 5/2000 |
| JP | 2000-315458 | | 11/2000 |
| WO | WO 2004105080 A1 | * | 12/2004 |

* cited by examiner

[Fig. 1]
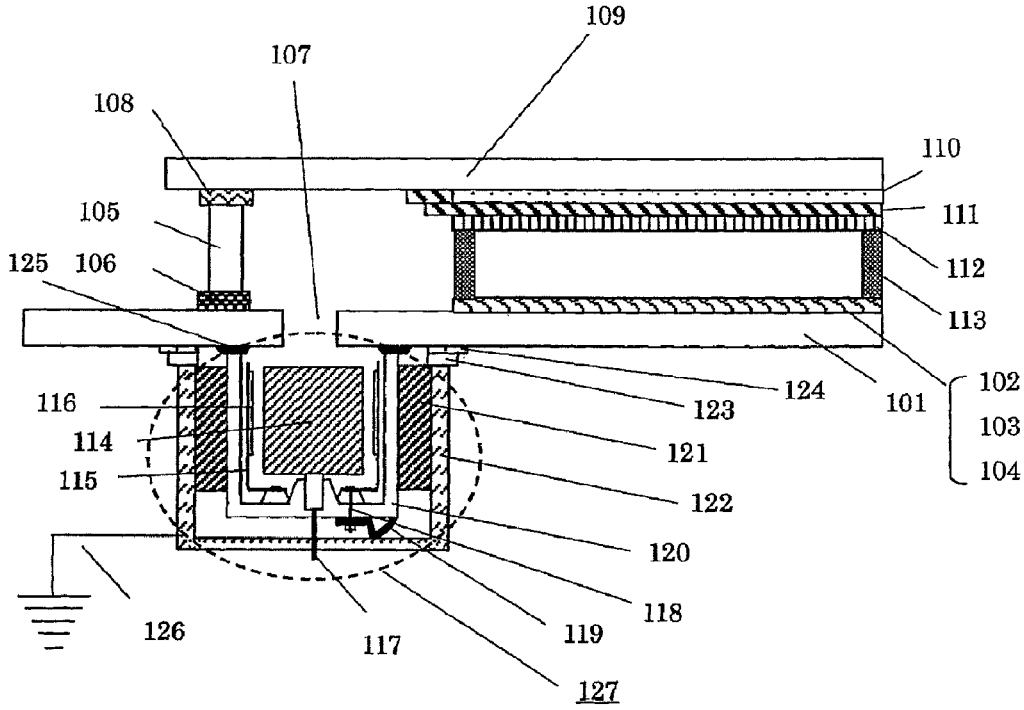
[Fig. 2]
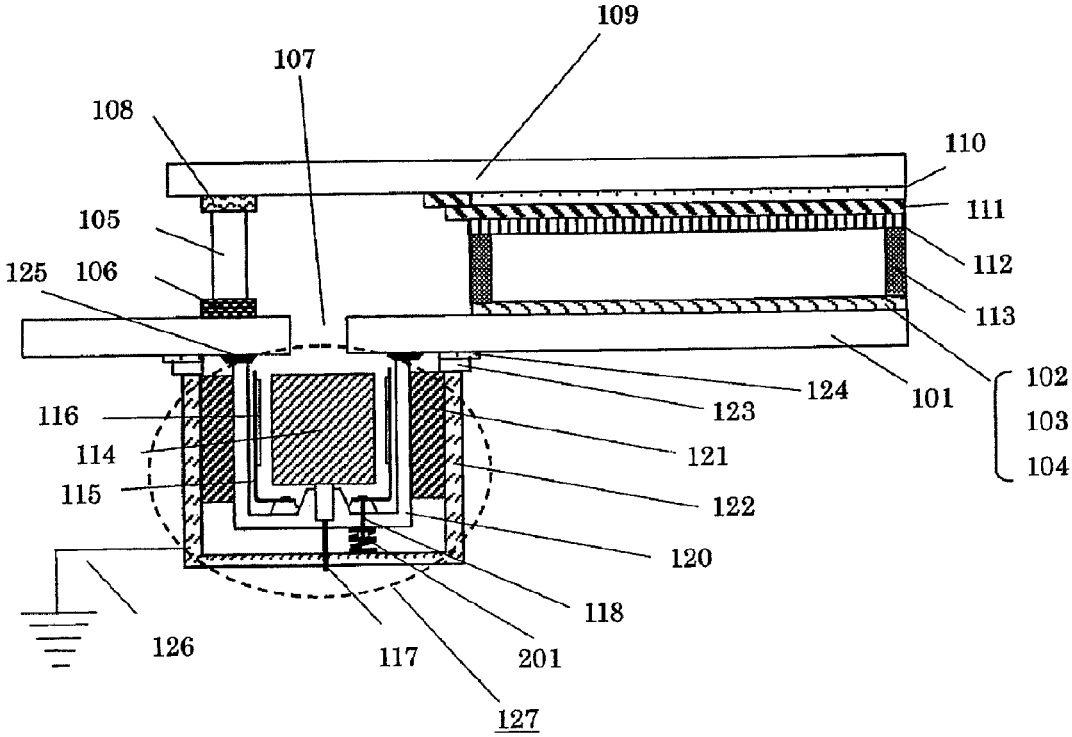

[Fig. 3]
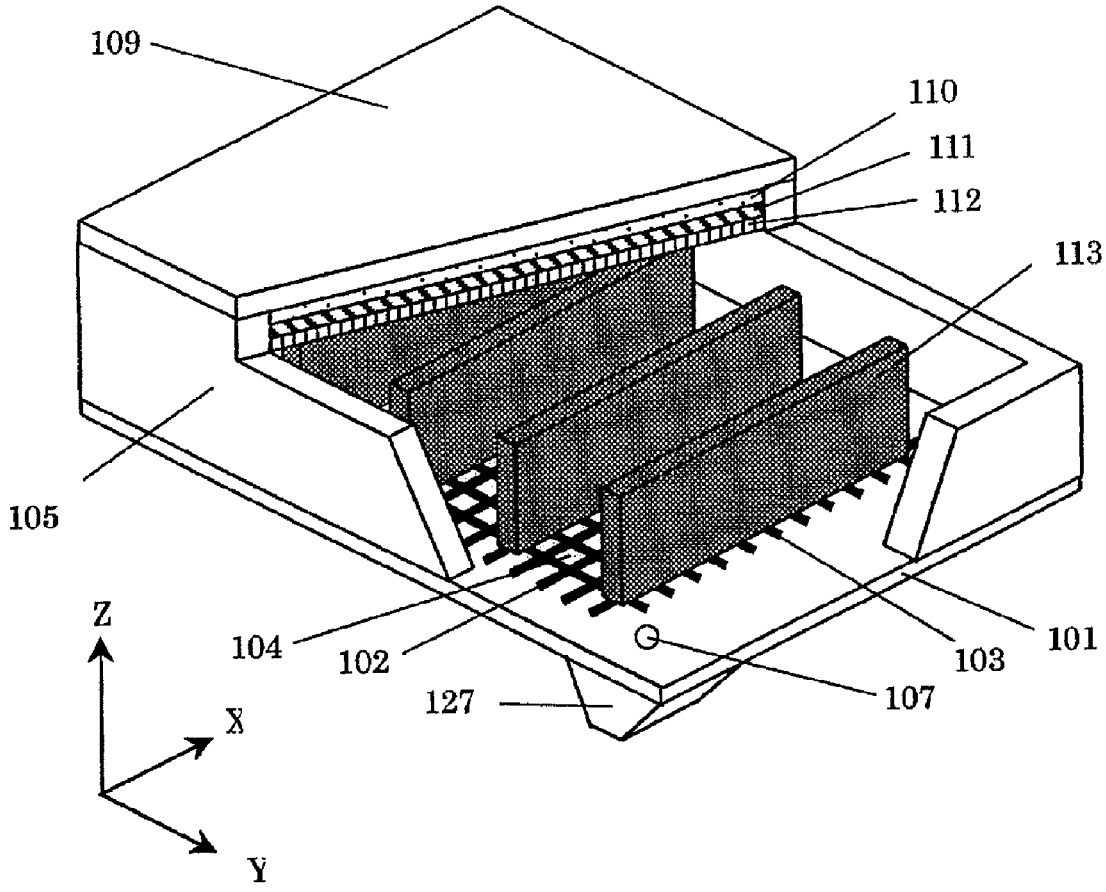

[Fig. 4]
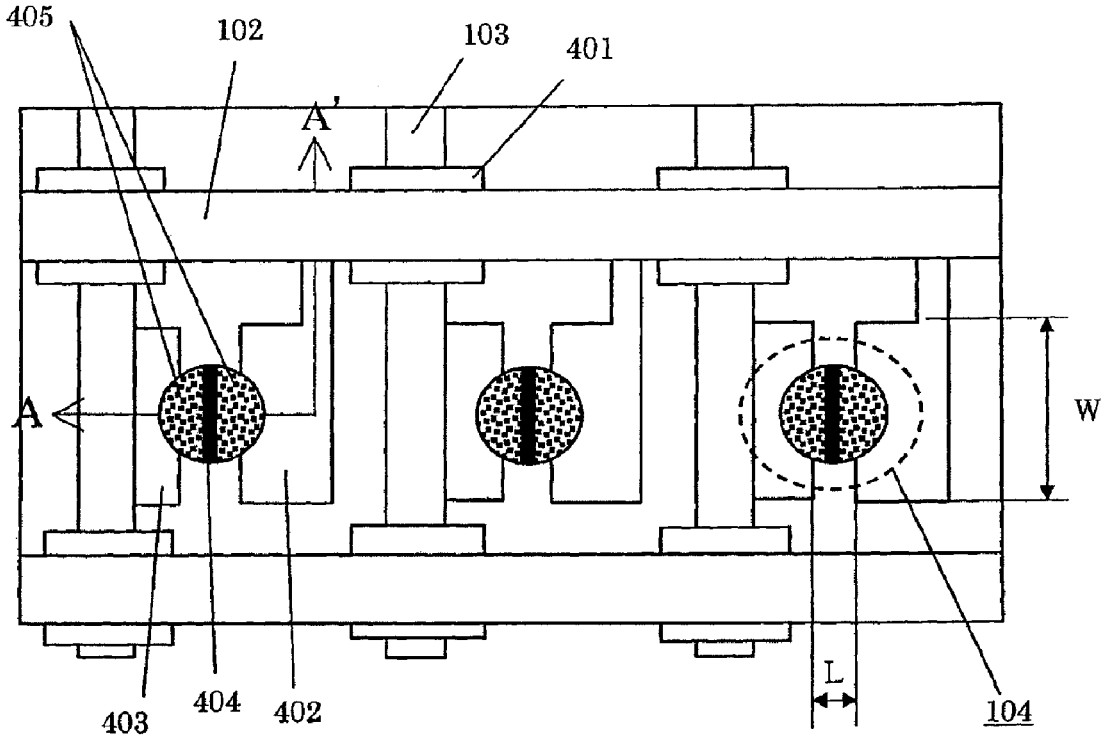
(a)
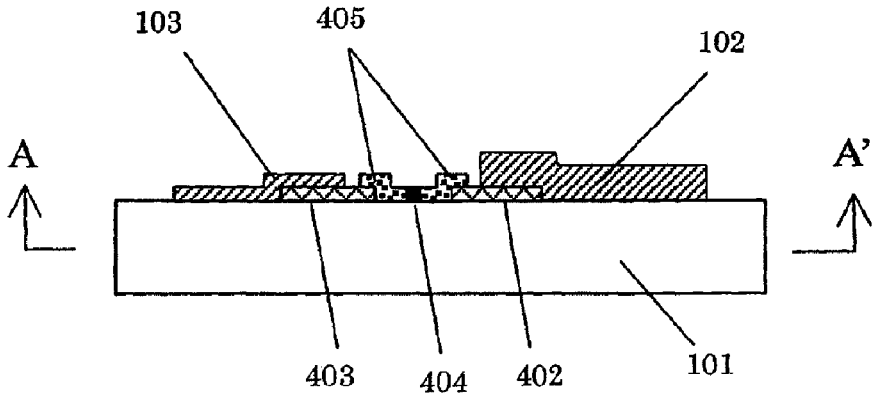
(b)

[Fig. 5]
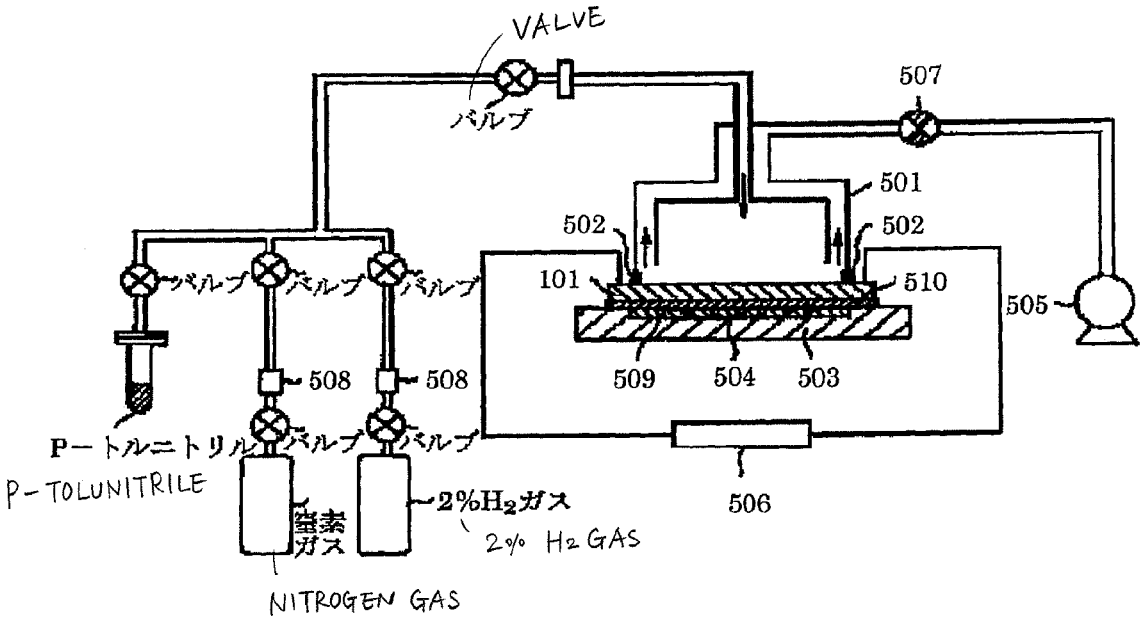
[Fig. 6]
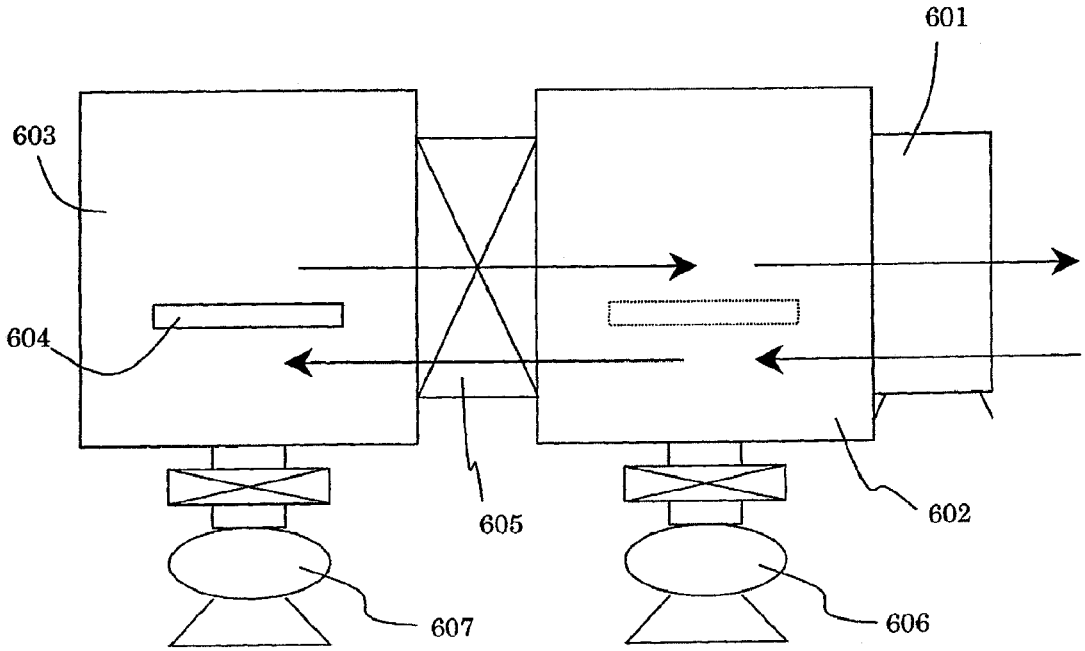

[Fig. 9]
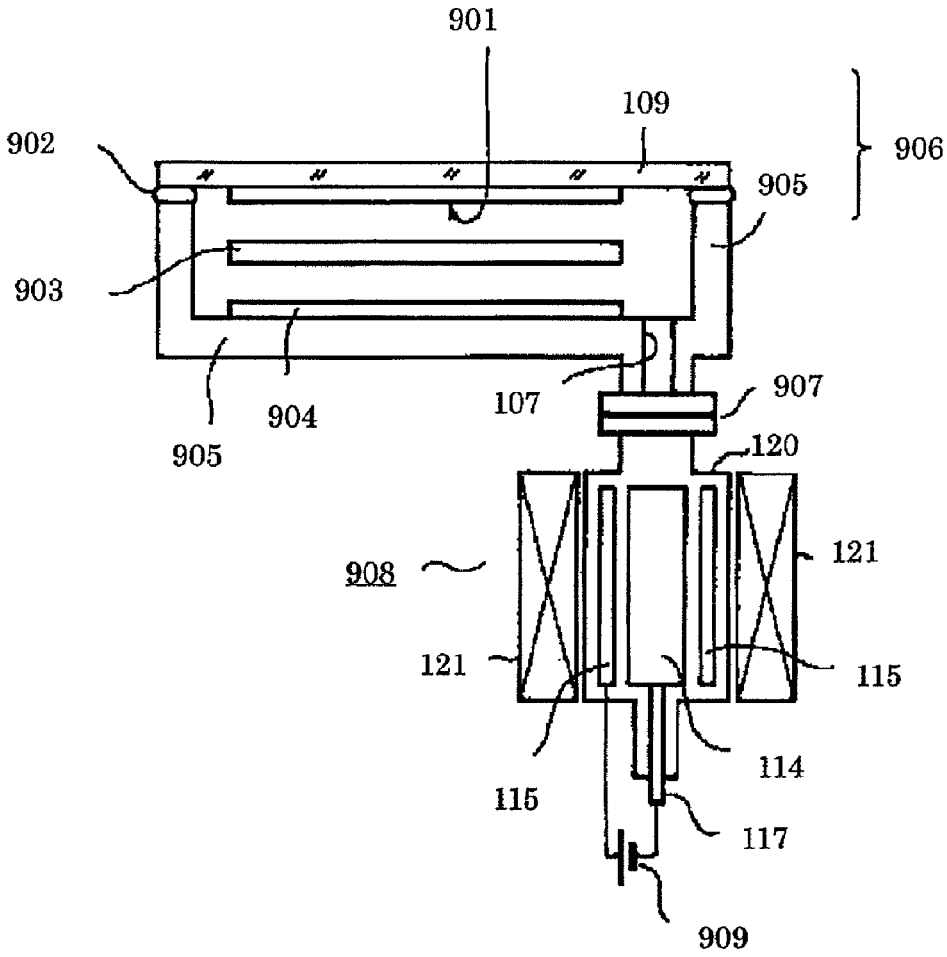
[Fig. 10]
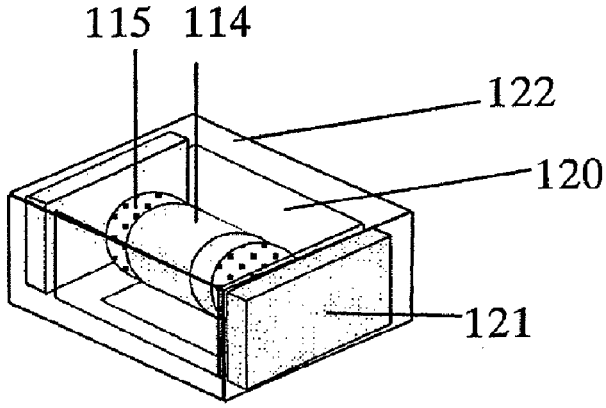

IMAGE DISPLAY DEVICE HAVING AN ION PUMP WITH REDUCED LEAKAGE

BACKGROUND OF THE INVENTION

1. Field of the Invention

The present invention relates to an image display apparatus using an electron-emitting device.

2. Related Background Art

A planar display which arranges many electron-emitting devices as electron sources on a planar substrate, irradiates phosphors of image forming members on a substrate with electron beams emitted from the electron sources on the opposite side to make the phosphors emit light and display images, requires the inside of a vacuum chamber accommodating the electron sources and the image forming members to be kept in a high vacuum. This is because an increase of a pressure due to generated gases in the vacuum chamber, though the extent of the effect depends on the types of the gases, adversely affects the electron sources to decrease an electron emission amount and hinder the display of a bright image.

Gases generated from image display members accumulate in the vicinity of an electron source before reaching a getter installed outside an image display area, locally increase pressure and deteriorate the electron source, which is a peculiar problem particularly to a planar display. Japanese Patent Application Laid-Open No. H09-82245 describes a method of arranging the getter in an image display region and making it immediately adsorb the generated gases to inhibit the deterioration and damage of elements. In addition, Japanese Patent Application Laid-Open No. 2000-133136 shows a configuration in which a non-evaporable getter is arranged in the image display region, and a evaporable type getter is arranged outside the image-display region. Furthermore, Japanese Patent Application Laid-Open No. 2000-315458 shows a method of performing a series of operations including degassing, getter forming and seal bonding (making the chamber into a vacuum) in an evacuating chamber.

There are a evaporable type getter and a non-evaporable getter in getters. The evaporable type getter has an extremely high speed of eliminating water and oxygen, but has a speed close to zero of eliminating an inert gas such as argon (Ar) (as does the non-evaporable getter). Argon gas is ionized by an electron beam to become positive ions, which are accelerated in the electric field that is provided for accelerating electrons and bombard the electron sources, damaging the latter. The positive ions further may discharge inside the vacuum chamber and damage the apparatus.

As for exhausting means capable of exhausting an inert gas, Japanese Patent Application Laid-Open No. H05-121012 describes a method of connecting a sputtering ion pump to a vacuum chamber of a planar display and keeping the vacuum chamber into a high vacuum for a long time.

The planar display, as shown in FIG. 9, has a configuration of a vacuum chamber 906 in which a face plate 109 having a phosphor film 901 and a main body 905 of a vessel are hermetically sealed with a sealant 902. An electrode body structure 904 is arranged in the above described main body 905 of the vessel, has a field emission type cathode, modulates electron beams emitted from the cathode with an internal electrode 903, in other words, a modulating electrode, and direct them toward the phosphor film 901 to display images. An ion pump 908 is connected to the main body 905 of the vessel for the purpose of keeping a vacuum. The ion pump 908, for instance in one embodiment, applies 1,000 gauss (0.1 tesla, the unit tesla of magnetic flux density is hereafter shown as T) by a magnet 121.

However, in a configuration in which an ion pump 908 is connected to a vacuum chamber 906 through a metallic seal 907 such as an ICF flange, a heavy metallic seal made of a metallic material is maldistributed in one side of a planar display. In addition, a magnet is directly attached to the ion pump chamber 120 without a yoke (ferromagnet), so that the ion pump chamber also becomes heavy. For this reason, the configuration causes problems of deforming or damaging a part for attaching the metallic seal 907 to the main body 905 of the vessel, when the ion pump 908 and the metallic seal 907 are joined to a main body 905 of the vessel, causing a leak of a vacuum in the vacuum chamber 906, and lowering a manufacturing yield.

In addition, the configuration has also a problem that noises caused by discharge having occurred in an ion pump interfere with an image in an image display apparatus.

SUMMARY OF THE INVENTION

The present invention is designed with respect to conventional problems, and is directed at providing a method for manufacturing an image display apparatus which produces few leaks, particularly hardly changes electron source characteristics with time, and has a high grade of display, high reliability and a low cost, with a simple step.

The present invention provides an image display apparatus comprising: a vacuum chamber constituted by an electron source substrate having a plurality of electron-emitting devices arranged thereon, and an image forming substrate which is arranged so as to face the electron source substrate, and has a phosphor film and an anode; and an ion pump having an ion pump chamber, an anode and a cathode accommodated in the ion pump chamber, and a magnet installed outside the ion pump chamber, wherein the ion pump chamber is connected to an aperture portion formed in the electron source substrate or the image forming substrate, and the magnet is fixed on the substrate to which the ion pump chamber has been connected.

BRIEF DESCRIPTION OF THE DRAWINGS

FIG. 1 is a view for explaining an image display apparatus having an ion pump according to the present invention;

FIG. 2 is a view for explaining an image display apparatus having an ion pump according to the present invention;

FIG. 3 is a schematic view showing a configuration of an image display apparatus;

FIGS. 4A and 4B are views for explaining one part of an electron source;

FIG. 5 is a view for explaining a foaming-activation step;

FIG. 6 is a schematic view showing a configuration of a vacuum treatment apparatus;

FIG. 9 is a schematic view showing a tabular image display apparatus having an ion pump according to a conventional embodiment; and FIG. 10 is a view showing an ion pump having a yoke attached.

DETAILED DESCRIPTION OF THE PREFERRED EMBODIMENTS

Figure 7:
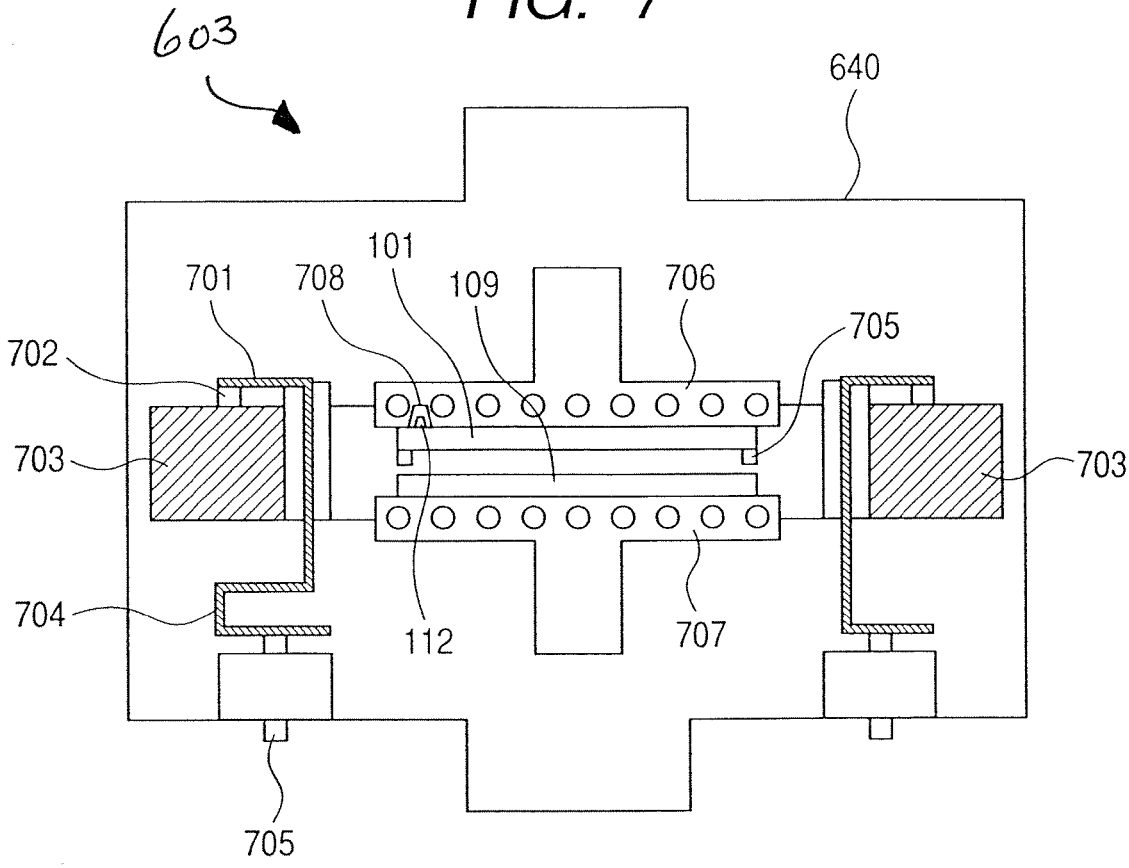
FIG. 7 is a view for explaining the steps of baking, getter flash and seal bonding in a vacuum treatment chamber.

The present invention relates to an image display apparatus comprising: a vacuum chamber constituted by an electron source substrate having a plurality of electron-emitting devices arranged thereon, and an image forming substrate which is arranged so as to face the electron source substrate, and has a phosphor film and an anode; and an ion pump having an ion pump chamber, an anode and a cathode accommodated in the ion pump chamber, and a magnet installed outside the ion pump chamber, wherein the ion pump chamber is connected to an aperture portion formed in the electron source substrate or the image forming substrate, and the magnet is fixed on the substrate to which the ion pump chamber has been connected.

The magnet is preferably attached to a holding portion fixed on a substrate to which the ion pump chamber is connected.

The holding portion is preferably connected to a cathode connecting terminal of the ion pump, and the holding portion is also preferably grounded.

The holding portion is preferably connected to a cathode connecting terminal of the ion pump with a spring.

In addition, the ion pump chamber is preferably connected to the electron source substrate or the image forming substrate with frit glass.

Furthermore, the holding portion is preferably fixed on a supporting member that is independently bonded to a substrate to which the ion pump chamber is connected.

An image display apparatus according to the present invention has an ion pump chamber compactly joined with frit glass to an electron source substrate or an image forming substrate, which composes a vacuum chamber, has no need of forming a protruding portion such as a flange for a metallic seal, and has a compact and light configuration which takes up a less space even if an ion pump is joined.

Furthermore, an image display apparatus according to the present invention has a magnet installed on a detachable holding portion and not directly installed on an ion pump, and accordingly does not apply excessively heavy force to the ion pump. For this reason, the present invention can provide an image display apparatus which does not cause problems such as the deformation and damage of a mounting part, hardly causes a leak, remarkably improves a manufacturing yield, and besides, has high impact resistance and high reliability.

In addition, an image display apparatus having such a configuration that a cathode connecting terminal of an ion pump is connected to a holding portion and the holding portion is grounded, shields electromagnetic waves generated by discharge by the grounded holding portion outside the ion pump, even when the discharge has occurred in the ion pump, and accordingly can extremely reduce the effect of noises to formed images.

As described above, the present invention can provide an image display apparatus which is inexpensive, has high reliability, exhibits a high-definition image and has the improved life, because an ion pump for adsorbing the gases which are generated when images are displayed and are hardly adsorbed in a getter can be easily attached thereto.

In the present invention, a holding portion is a member for holding a magnet, and functions as a yoke (a ferromagnet) when the material is suitably selected. When the holding portion functions as the yoke, it can effectively utilize a magnetic field, and accordingly provides an effect of eliminating the need for using a magnet with a larger magnetic field than required. Because the holding portion which is not the yoke only employs a different material, in the following explanation, an example of the holding portion functioning also as the yoke will be explained.

A preferred embodiment will be now explained below in detail referring to drawings. The present invention will be now explained referring to FIGS. 1 to 7. In the following explanation, an electron source substrate will be explained as a rear plate and an image forming substrate as a face plate.

(Explanation of Method for Installing Ion Pump)

FIGS. 1 to 3 are one example of schematic views showing a configuration of an image display panel produced according to the present invention. FIG. 1 is a view showing the present invention most thoroughly. A rear plate 101 has an upper wiring 102, a lower wiring 103 and a surface conduction type electron-emitting device 104 (an electron source) of an electron-emitting member having an electron-emitting portion formed thereon, on the inner side of a transparent glass substrate; a face plate 109 has a phosphor film 110 coated on the inner side of the transparent glass substrate, a metallic back film 111 which is an anode film, and a getter film 112; a supporting frame 105 is joined to the rear plate 101 with frit glass 106; and an ion pump 127 is joined to an exhaust port (an aperture portion) 107 of the rear plate 101 with the frit glass. The supporting frame 105 and the face plate 109 are heated and seal-bonded with the use of a metal such as indium in a vacuum to form an envelope which is a vacuum chamber.

An ion pump 127 is constituted by an ion pump chamber 120 having an anode 114, a cathode 115, a Ti electrode 116, an anode connecting terminal 117 and a cathode connecting terminal 118; and a yoke 122 to which a magnet 121 is attached. In addition, in the configuration, a cathode connecting terminal 118 is connected to the yoke 122 with a flat spring 119, and furthermore, the yoke is connected to the ground 126.

Here, an ion pump chamber 120 is joined to a rear plate 101 with frit glass 125, and a yoke 122 is detachably fixed on a supporting plate (a supporting member) 123 which is bonded to a rear plate 101 with an adhesive 124. An anode connecting terminal 117 and a cathode connecting terminal 118 are connected to an ion pump power source (not shown) for driving the ion pump by wiring.

FIG. 2 shows another embodiment in which a cathode connecting terminal 118 and a yoke 122 are connected by a coiled spring 201 in stead of a flat spring 119 shown in FIG. 1.

An ion pump chamber accommodates an anode and a cathode therein, is communicated with and connected to the vacuum chamber, and thereby keeps the inside of a vessel and a vacuum chamber of an image display apparatus in communication with the vessel, to a reduced pressure or a vacuum.

An ion pump used in the present invention can be appropriately selected among an Evapor-ion pump having a getter film vapor-deposited on a pump wall, a Sputter-ion pump which utilizes the ion itself for sputtering the getter film and the like. Among them, a sputter-ion pump can be preferably used because of having a simple configuration, and a possibility of being miniaturized and reducing the weight.

A material of composing an ion pump chamber can be appropriately selected among glass, ceramic and metal, and a glass structure composed of a pressed glass and/or a glass plate joined with frit glass is preferably used from the viewpoint of weight reduction and size reduction.

An ion pump chamber and a face plate or a rear plate can be joined with the use of a suitable adhesive which can keep a vacuum, but frit glass is preferably used. When they are joined with only the frit glass, the joined area hardly causes a leak, provides sufficiently high strength, remarkably improves a manufacturing yield, and enables an image display apparatus having high impact resistance and high reliability to be manufactured.

The usable base material of frit glass includes $SiO_2$-based glass, Te-based glass, PbO-based glass, $V_2O_5$-based glass and Zn-based glass according to the component. Practically used glass contains oxide fillers which is added to the base material to obtain a controlled coefficient of thermal expansion $\alpha$. The above described refractory filler includes $PbTiO_3$, $ZrSiO_4$, $Li_2O—Al_2O_3$-$2SiO_2$, $2MgO$-$2Al_2O_3$-$5SiO_2$, $Li_2O—Al_2O_3$-$4SiO_3$, $Al_2O_3—TiO_2$, $2ZnO—SiO_2$, $SiO_2$ and $SnO_2$. The practically usable frit glass contains one or more fillers among them.

In a case where frit glass has been used for joining by being baked in a vacuum atmosphere or an inert atmosphere, is accompanied by foaming and cannot secure adhesive strength and hermeticity. Accordingly, it is preferable that the frit glass is temporarily baked in the atmosphere and is heated in a vacuum atmosphere for the purpose of defoaming, and then is used for joining.

Because frit glass is a powder, it is converted to a paste form with the use of an organic binder, and is applied to an area to be joined when it is used. A method for applying the frit glass which has been made pasty is generally a dispense method using an air pressure, but can appropriately employ a dipping method and a printing method. Alternatively, a preformed article can be used which has been previously formed into a ring-shaped and a strip-shaped sheet, then temporarily baked and degassed.

Because frit glass becomes somewhat flowable at a baked temperature when baked, a pressing pressure for flattening it is required, and a preferably used pressing pressure is 0.5 $g/mm^2$ or higher.

A magnet is arranged outside an ion pump chamber, and an image display apparatus according to the present invention has a configuration of covering the perimeter of the magnet with a yoke (a feromagnet). As shown in FIG. 10 of a diagrammatic schematic view, the whole ion pump 5 may be covered with the yoke 122 from five directions, or may have a bridge structure only in one direction (a structure covered from three directions). In FIG. 10, an anode connecting terminal and a cathode connecting terminal are not shown. The arranged yoke can increase magnetic flux density in an effective part, accordingly can thin the magnet, may not use a magnet having a large magnetic field, and besides, shows an effect of limiting the spread of a magnetic flux.

In addition, in an image display apparatus according to the present invention, a magnet is attached to a yoke, which reduces a weight load to an ion pump chamber, eliminates a leak particularly caused by problems such as breakage in a joined area between the ion pump chamber and a substrate, and improves reliability.

As is shown in FIGS. 1 and 2, a yoke 122 is attached to a substrate to which an ion pump is joined, so as to surround the ion pump. Preferably, a supporting member (a supporting plate 123 in the figure) is temporarily fixed on a rear plate, and then a yoke is attached to the supporting member.

At first, a supporting member 123 for supporting a yoke 122 is bonded onto a rear plate 101 with a bonding adhesive 124 so as to surround an ion pump chamber 120. The supporting member (a supporting plate) has only to play a role in attaching the yoke to a substrate, so that the material can preferably form an internal thread therein, and usable material includes plastic and metal.

An adhesive used in the present invention has only to have strength for retaining a yoke 122 and a flexibility capable of absorbing a twisting stress caused by a camber of a rear plate 101, and can be appropriately selected among an epoxy-based adhesive, an urethane-based adhesive, an emulsion-based adhesive, a synthetic rubber-based adhesive, an elastic adhesive, an instant adhesive and a structural adhesive, but the epoxy-based adhesive can be preferably used from the viewpoint of workability and reliability.

A yoke material used in the present invention can be appropriately selected among a soft magnetic iron sheet, an electrolytic iron foil, a silicon steel sheet, an amorphous alloy and a nanocrystal soft magnetic material, but a permalloy can be preferably used from the viewpoint of performance and a cost.

Subsequently, a magnet 121 is attached to a yoke 122, and the yoke 122 is then fixed by a screw to an appropriate position on a supporting plate 123 so that the maximum magnetic field can be applied on the center of an ion pump, through the measurement of a magnetic field with the use of a gauss meter and the adjustment of the position. A fixing method is not limited to the screw but has only to be removable means.

In addition, in a preferred embodiment as shown in FIGS. 1 and 2, a cathode connecting terminal of an ion pump is connected with a yoke by a spring, and the above described yoke is grounded. According to such a configuration, the grounded yoke arranged outside the ion pump shields electromagnetic waves generated by discharge, even when it occurs in the ion pump, and accordingly can extremely reduce an effect of a noise onto images formed in an image display apparatus.

A connecting material between a cathode connecting terminal of an ion pump and a yoke has only to be electrically conductive, but a spring is particularly preferable because of showing an effect of stabilizing an ion pump chamber 120 by supporting it with the yoke 122. The shape of the spring includes a flat spring shown in FIG. 1 and a coiled spring shown in FIG. 2. A usable material of the spring can be appropriately selected among metals for a spring, but a copper alloy such as phosphor copper, brass, beryllium copper and a titanium copper alloy superior in electroconductivity, nonmagnetism, corrosion resistance and workability can be preferably used.

(Explanation of Whole Image Display Apparatus)

An image display apparatus shown in FIG. 3 displays images by applying a high voltage for a modulating signal input from a terminal outside a vessel (not shown) through a lower wiring 103, and a voltage for a scan signal input through an upper wiring 102, by using a high-voltage terminal Hv (not shown). A yoke 122 accommodating an ion pump is connected to a vacuum chamber with an exhaust port (an aperture portion) 107, and a released gas is exhausted through the exhaust port by a driving power source (not shown). In the same figure, reference numeral 104 denotes a surface conduction type electron-emitting device which is an electron source, and reference numerals 102 and 103 denote upper wiring (Y-direction wiring) and lower wiring (X-direction wiring) connected to a pair of element electrodes of the surface conduction type electron-emitting device.

FIG. 4A is a schematic view showing a surface conduction type electron-emitting device 104 arranged on a rear plate 101, and one part of wiring for driving the electron source. In the same figure, reference numeral 103 denotes lower wiring, reference numeral 102 denotes upper wiring, and reference numeral 401 denotes an interlayer insulating film which electrically insulates the upper wiring 102 from the lower wiring 103.

FIG. 4B shows the structure of a surface conduction type electron-emitting device 104 of a section surrounded by lines 4B and 4B in FIG. 4A by enlarging it, and reference numerals 402 and 403 denote element electrodes, reference numeral 405 denotes an electroconductive thin film and reference numeral 404 denotes an electron-emitting portion.

In the first place, an example of an image display apparatus using a surface conduction type electron-emitting device will be described. In a configuration shown in FIGS. 1 and 3, a rear plate 101 is made of an insulating substrate such as a glass substrate having soda glass, borosilicate glass, quartz glass and $SiO_2$ formed on the surface, and a ceramic substrate such as alumina, and a face plate 109 is made of a glass substrate such as transparent soda glass.

A usable material for element electrodes (corresponding to 402 and 403 in FIGS. 4A and 4B) of a surface conduction type electron-emitting device 104 is a general conductor, and is appropriately selected among, for instance, a metal such as Ni, Cr, Au, Mo, W, Pt, Ti, Al, Cu and Pd or an alloy thereof, a printed conductor comprising a metal such as Pd, Ag, Au, $RuO_2$ and Pd—Ag, or a metal oxide thereof and glass, a transparent electric conductor such as $In_2O_3$—$SnO_2$, and a semiconductor material such as polysilicon.

An element electrode can be formed by the steps of: forming the film of the element electrode with the use of a vacuum deposition method, a sputtering method and a chemical-vapor deposition method; and processing it into a desired shape with a photolithographic technology (including a processing technology such as an etching technique and a lift-off technique) or other printing methods. To sum up, the element electrode has only to be formed into the desired shape from the above described material, and may be produced with any method.

A space L between element electrodes shown in FIG. 4A is preferably several hundred nanometers to several hundred micrometers. Because the element electrodes are required to be processed with adequate reproducibility, the space L between the element electrodes is more preferably several micrometers to several tens of micrometers. The length W of the element electrode is preferably several micrometers to several hundred micrometers in consideration of the ohmic value and electron emission characteristics of the electrodes, and the film thicknesses of the element electrodes 402 and 403 are preferably several tens of nanometers to several micrometers. The configuration is not limited to only that shown in FIG. 4B, but may be that having an electroconductive thin film 405 and an element electrode 402 and an element electrode 403 sequentially formed on a rear plate 101.

An electroconductive thin film 405 is particularly preferably a fine particle film composed of fine particles in order to provide adequate electron emission characteristics, and has a film thickness preferably of 0.1 nm to several hundred nanometers, and particularly preferably of 1 to 50 nm, though it is set according to a step coverage onto element electrodes 402 and 403, an ohmic value between the element electrodes 402 and 403, and an energization forming condition to be described later. The ohmic value Rs is 102 to $10^7$ Ω/square. The above Rs is a quantity appearing when a resistance R of a thin film has a thickness of t, a width of w and a length of l, and has a relationship expressed by R=Rs(l/w).

In addition, a material of composing an electroconductive thin film 405 includes a metal such as Pd, Pt, Ru, Ag, Au, Ti, In, Cu, Cr, Fe, Zn, Sn, Ta, W and Pb, an oxide such as PdO, $SnO_2$, $In_2O_3$, PbO and $Sb_2O_3$, an boride such as $HfB_2$, $ZrB_2$, $LaB_6$, $CeB_6$, $YB_4$ and $GdB_4$, a carbide such as TiC, ZrC, HfC, TaC, SiC and WC, a nitride such as TiN, ZrN and HfN, a semiconductor such as Si and Ge, and carbon.

In addition, a fine particle film described here is a film in which a plurality of agglomerated fine particles aggregate, and has a fine structure in which the fine particles are not only separately dispersed and placed, but also are contacted or overlapped with each other (including forming islands). Here, the fine particles have diameters of 0.1 nm to several hundred nanometers, and preferably of 1 to 20 nm.

An electroconductive thin film 405 is prepared by the steps of: providing element electrodes 402 and 403 on a rear plate 101; and forming an organometallic thin film thereon by applying an organometallic solution and drying it. The organometallic solution described here means a solution of an organometallic compound containing a metal of forming the above described electroconductive thin film 405 as a main element.

An electroconductive thin film 405 is formed by subsequently heating an organometallic thin film to bake it, and patterning the baked thin film by lift-off, etching and the like. In the above explanation, a method for forming the electroconductive thin film 405 by applying an organometallic solution was described, but is not limited thereto, and the electroconductive thin film may be formed with a vacuum deposition method, a sputtering method, a chemical-vapor deposition method, a dispersion application method, a dipping method and a spinner method.

An electron-emitting portion 404 is a crack with a high resistance, formed on one part of an electroconductive thin film 405, and is formed by treatment called energization forming. The energization forming is treatment for changing the structure of the electroconductive thin film 405 into a new structure, by passing an electric current between element electrodes 402 and 403 from electrodes which are not shown in the figure, and locally breaking, deforming or deteriorating the electroconductive thin film 405. A voltage waveform during energization is particularly preferably a pulse form, and an energization method includes a method of continuously applying voltage pulses with constant pulse height and a method of applying the voltage pulses while increasing the pulse height. Forming treatment is not limited to energization treatment, but may employ treatment of forming a space such as a crack in the electroconductive thin film 405 to make the film into a high-resistance condition.

An element having the treatment of energization forming finished thereon is preferably subjected to treatment called activation. The activation treatment is the treatment of remarkably changing an element current (an electric current passing between element electrodes 402 and 403) and an emission current (an element current emitted from an electron-emitting portion 404). The activation treatment can be performed, for instance, by repeating the application of pulses as in the case of the energization forming, under an atmosphere containing a gas of a carbon compound such as a gas of an organic substance. A preferred pressure in a gaseous atmosphere of the organic substance employed at this time is appropriately set according to cases, because the pressure differs according to the shape of a vacuum chamber of arranging an element therein and the type of an organic substance.

Activation treatment deposits an organic substance existing in an atmosphere to form an organic thin film consisting of carbon or carbon compounds on an electroconductive thin film 405.

Activation treatment is finished when an element current and the emission current are measured, and for instance, an emission current saturates. A voltage pulse to be applied for the activation treatment has preferably equal voltage to or higher voltage than an operation-driving voltage when images are displayed.

A formed crack may contain electroconductive fine particles therein with diameters of 0.1 nm to several tens of nanometers. The electroconductive fine particles contain at least one part of elements of substances composing an electroconductive thin film 405. In addition, an electron-emitting portion 404 and the electroconductive thin film 405 around it occasionally contains carbon and carbon compounds.

In addition, a surface conduction type electron-emitting device 104 may be not only a planar type having the surface conduction type electron-emitting device 104 formed on a rear plate 101 in a planar form, but also a perpendicular type having the surface conduction type electron-emitting device 104 formed on the surface perpendicular to the rear plate 101; and is not particularly limited and has only to be an element for emitting electrons, in a word, any electron-emitting device used in an image display apparatus, such as a thermal electron source using a heat cathode and a field emission type electron-emitting device.

In the next place, the arrangement of a surface conduction type electron-emitting device 104 and wiring for supplying electric (electric power) signals for displaying images to the device will be described referring to FIGS. 3, 4A and 4B.

An example of usable wiring can be a combination of two wirings which are perpendicular each other (Y: upper wiring 102 and X: lower wiring 103, which is called simple matrix wiring). In the wiring, the upper wiring 102 is connected to an element electrode 402 of a surface type electron-emitting device 104 and the lower wiring 103 is connected to an element electrode 403 of the device 104. The upper wiring 102 and the lower wiring 103 can be formed of an electroconductive metal or the like with a vacuum deposition method, a printing method such as a screen printing method and an offset printing method, and a sputtering method, and the materials, the film thicknesses and the widths are appropriately designed. Among them, the printing method is preferably used because of being manufactured in a low cost and easily handled.

An electroconductive paste to be used includes a single noble metal such as Ag, Au, Pd and Pt, a single base metal such as Cu and Ni, or an arbitrarily combined metal thereof. A wiring pattern is formed by printing the paste with a printing machine, and baking it at 500° C. or higher. The formed upper and lower printed wirings have thicknesses of several micrometers to several hundred micrometers. Furthermore, at least in a position in which the upper wiring 102 and the lower wiring 103 are overlapped, an interlayer insulating film 401 with a thickness of several micrometers to several hundred micrometers is formed by printing the glass paste and baking it (at 500° C. or higher) to electrically isolate the wirings.

To an end of upper wiring 102 in a Y direction, a scan signal of an image display signal for scanning the row of the Y side of a surface conduction type electron-emitting device 104 in response to an input signal is applied, and accordingly is electrically connected to a driving circuit of means for driving a scan side electrode. On the other hand, to the end of lower wiring in the X direction, a modulating signal of an image display signal for modulating each column of the surface conduction type electron-emitting device 104 in response to an input signal is applied, and accordingly is electrically connected to a driving circuit of means for driving a modulating signal.

A phosphor film 110 coated on inner face of a face plate 109 is made of a single phosphor in a monochrome display, but in a display for showing color images, has a structure of separating the phosphors of emitting lights of the three primary colors of red, green and blue with a black electroconductive material. The black electroconductive material is called a black stripe or a black matrix according to its shape. The phosphor film consisting of the phosphors with each color is formed by applying phosphor slurry, and patterning it into picture elements having desired sizes with a photolithographic method or a printing method.

On a phosphor film 110, a metallic back film 111 of an anode film is formed. The metallic back film 111 is formed of an electroconductive film such as Al. The metallic back film 111 reflects light which travels in a direction toward a rear plate 101 of an electron source among the light generated in the phosphor film 110, to improve the brightness of images. Furthermore, the metallic back film 111 gives electroconductivity to an image display region of a face plate 109 to prevent the accumulation of electric charge, and plays a role of an anode for a surface conduction type electron-emitting device 104 on the rear plate 101. The metallic back film 111 has also a function of preventing the phosphor film 110 from being damaged by ions formed by a reaction in which gases remaining in the face plate 109 and the image display apparatus are ionized with electron beams.

A metallic back film 111 to which a high voltage is applied, shall be electrically connected to a high-voltage-applying device.

A supporting frame 105 hermetically seals a space between a face plate 109 and a rear plate 101. The supporting frame 105 composes a sealed vessel of an envelope by being joined to the face plate 109 with the use of In (indium) 108, and being joined to the rear plate 101 with frit glass 106. The supporting frame 105 can employ the same material as the face plate 109 and the rear plate 101, or glass, ceramic or metal having a similar coefficient of thermal expansion to them.

A supporting frame 105 is preferably joined to a rear plate 101 with frit glass 106, before an electron-emitting portion 404 is formed, in other words, before being subjected to forming treatment and activation treatment. In the case of joining the supporting frame 105 with In, the supporting frame 105 is preferably joined to a face plate 201 and the rear plate 101 at the same time when forming a sealed vessel with them.

After a supporting frame 105 has been joined to a rear plate 101 with frit glass 106, an ion pump chamber 120 is joined to the rear plate 101 with frit glass 125.

As is shown in FIG. 1, an ion pump chamber 120 having frit glass 125 coated thereon is pressed to the surface of a rear plate 101 opposite to the surface having a surface conduction type electron-emitting device 104 formed thereon, and around an outlet 107, with a load given; and is heated in a vacuum baking furnace in a state of having been exhausted to a reduced pressure to melt the frit glass 125 and join itself to the rear plate 101. A weight has the role of preventing the chamber from being displaced when the frit glass 125 has been heated and melted, and of pressing the frit glass 125 into a constant thickness.

Frit glass used in the present invention may employ a material selected among a $SiO_2$ base, a Te base, a PbO base, a $V_2O_5$ base and a Zn base, which are classified according to the component, and practically is appropriately mixed with an oxide filler to adjust a heat expansion coefficient $\alpha$, before being used. The above described refractory filler includes $PbTiO_3$, $ZrSiO_4$, $Li_2O$—$Al_2O_3$-$2SiO_2$, 2MgO-2 $Al_2O_3$-$5SiO_2$, $Li_2O$—$Al_2O_3$-$4SiO_3$, $Al_2O_3$—$TiO_2$, 2ZnO—$SiO_2$, $SiO_2$ and $SnO_2$. The frit glass can be appropriately used after having been mixed with one or more fillers among them.

When frit glass is directly baked in a vacuum atmosphere or an inert atmosphere, it is accompanied by foaming and cannot secure adhesive strength and hermeticity. Accordingly, it is preferable to temporarily bake the frit glass in the atmosphere, heat it in a vacuum atmosphere to defoam it, and then use it for joining.

Because frit glass is a powder, it is converted to a paste form with the use of an organic binder, and is applied to an area to be joined when it is used. A method for applying the frit glass which has been made pasty is generally a dispense method using an air pressure, but can appropriately employ a dipping method and a printing method. Alternatively, a preformed article can be used which has been previously formed into a ring-shaped or strip-shaped sheet, then temporarily baked and degassed.

Because frit glass becomes somewhat flowable at a baked temperature when baked, a pressing pressure for flattening it is required, and a preferably used pressing pressure is 0.5 $g/mm^2$ or higher.

For an ion pump, as described above, a sputter-ion pump can be preferably used because of having a simple configuration, and a possibility of being miniaturized and reducing the weight. In addition, a material of an ion pump chamber can be appropriately selected among glass, ceramic and metal, and a glass structure composed of a pressed glass and/or a glass plate joined with frit glass is preferably used from the viewpoint of weight reduction and size reduction. Ti, Ta and the like are preferably used for a metal used as a cathode.

After a rear plate 101 having been joined to a supporting frame 105 and an ion pump chamber 120 and a face plate 109 have been prepared, they are subjected to the steps of: electron beam cleaning for the substrates, formation of a getter film 112 by vapor deposition, and formation of a sealed vessel of an envelope (joining of the face plate 109 to the rear plate 101 to which the supporting frame 105 and the ion pump chamber 120 are joined), which are performed in an atmosphere kept to a vacuum.

FIG. 6 shows a whole conceptional diagram of a vacuum treatment apparatus used in the present invention. A load chamber 602 is used for importing and exporting a substrate, and a vacuum treatment chamber 603 is used for baking it, forming a getter film thereon and seal bonding it therein. A gate valve 605 is installed to separate the load chamber 602 from the vacuum treatment chamber 603, and a transportation holder 604 transports the substrate. The load chamber 602 is evacuated by evacuating means 1 (606), and the vacuum treatment chamber 603 is evacuated by evacuating means 2 (607). The substrate is exported and imported through an exporting and importing port 601.

FIG. 7 shows a conceptual diagram of steps performed in a vacuum treatment chamber 603. In FIG. 7, numerical character 706 denotes an upper hot plate and numerical character 707 denotes a lower hot plate, and other components having the same numerical characters as the above described numerical characters denote the same members.

A face plate 109 having a phosphor film 110 and a metallic back film 111 formed thereon and a rear plate 101 having a supporting frame 105 and an ion pump chamber 120 joined thereto are together mounted on a transportation holder 604, as shown in FIG. 6, and imported into an atmospherically-opened load chamber 602 through an opened exporting and importing port 601. Then, the load chamber 602 is exhausted into a pressure of $10^{-4}$ Pa or lower. Subsequently, a gate valve 605 communicated to a vacuum treatment chamber 603 which has been previously evacuated with evacuating means 2 (607) into the pressure of about $10^{-5}$ Pa, is opened, the transportation holder 604 is transported to the vacuum treatment chamber 603, and the gate valve 605 is closed.

A usable material for a getter film includes a metal such as Ba, Mg, Ca, Ti, Zr, Hf, V, Nb, Ta, W, and the alloy thereof, but preferably is Ba, Mg, Ca, or an alloy thereof, which is easy-to-handle alkali earth metal with a low vapor pressure. Among them, Ba or the alloy containing Ba is preferable, because of being inexpensive, capable of easily vaporizing from a metallic capsule for holding a getter material, and industrially and easily manufactured.

Subsequently, an outline of a manufacturing process to be performed in a vacuum treatment chamber 603 is shown in FIG. 7. As is shown in the figure, a face plate 109 and a rear plate 101 are imported to the vacuum treatment chamber 603, are respectively held on a lower hot plate 707 and an upper hot plate 706, and are subjected to degassing treatment by heating and baking. At this time, the rear plate 101 is held on the upper hot plate 706, so that in order to damage an ion pump chamber 120 joined to the back surface of the rear plate 101, the upper hot plate 706 has a run off 708 formed therein. A baking temperature can be appropriately selected from temperatures between 50 and 400° C., but high-temperature is preferable as long as the heat resistance of a member allows. Subsequently, the rear plate 101 is moved up simultaneously with separating each of the hot plates to upper and lower directions, and a space is provided above the upper surface of the face plate 109. A holder 703 on a lid of one side is moved into the space, and set on the face plate 109. A getter film 112 is formed on a half face of the face plate 109 by supplying an electric current from an outside power source through a brush-shaped contact electrode 705, a wiring terminal 704 and a wiring 702 all for the getter film, and flashing a getter by heating.

Similarly, a getter film 112 is formed on a remaining half face. Subsequently, a vacuum chamber (a vacuum envelope) surrounded by a face plate 109, a rear plate 101 and a supporting frame 105 is formed by the steps of: moving a lid-shaped holder 703 toward a previous position; sandwiching again the face plate 109 having an In alloy coated thereon and the rear plate 101 having a supporting frame 105 and an ion pump chamber 120 previously joined to itself, in a predetermined position between an upper hot plate 706 and a lower hot plate 707; and applying a load on them while heating them to melt the In alloy.

When an image display apparatus of displaying color images is manufactured, the vacuum chamber is formed by matching the positions of a face plate 109 and a rear plate 101 so as to match the positions of a surface conduction type electron-emitting device 104 and a picture element (not shown) of a phosphor film 110 into one-to-one correspondence, and seal-bonding them in a vacuum. Then, it is cooled to about room temperature. Subsequently, an upper hot plate 706 and a lower hot plate 707 are respectively moved in an upper direction and a lower direction, a sealed vessel is transported to a road chamber 602 and taken out from an exporting and importing port 601.

In the steps described above, a space surrounded by a rear plate 101, a supporting frame 105 and a face plate 109 is formed into a vacuum chamber which can keep itself sealed into ambient pressure or lower.

Subsequently, a flat spring 119 is connected to a cathode connecting terminal 118 attached outside an ion pump chamber 120 with the use of solder, indium or the like. A cathode connecting terminal 118 has a structure capable of being connected to the outside with the use of a Dumet wire.

Subsequently, a supporting member 123 for supporting a yoke 122 is bonded onto a rear plate 101 with a bonding adhesive 124 so as to surround an ion pump chamber 120. As described above, an epoxy-based adhesive is used as the adhesive. A permalloy, for example, is used as a material for the yoke.

Subsequently, a magnet 121 is attached to a yoke 122, and the yoke 122 is then fixed by a screw to an appropriate position on a supporting plate 123 so that the maximum magnetic field can be applied on the center of an ion pump, through the measurement of a magnetic field with the use of a gauss meter and the adjustment of the position. The yoke 122 is grounded with a grounding conductor 126. An ion pump power source (not shown), an anode connecting terminal 117 and a cathode connecting terminal 117 are connected by wiring.

A vacuum chamber becomes an image display apparatus by a series of the above described treatments. An ion pump power source (not shown) of the image display apparatus produced as described above is switched on to operate an ion pump. Subsequently, scan signals and modulating signals which are picture signals, are provided to each surface conduction type electron-emitting device 104 from scan driving means connected to upper wiring 102 and modulation, driving means connected to lower wiring 103.

A drive voltage of a difference voltage between scan signals and modulating signals, in other words, an electrical signal is applied to element electrodes, an electric current passes through an electroconductive thin film 405, one part of the current is changed to electrons at an electron-emitting portion 404 of a crack, and the electrons are emitted as an electron beam in response to the above described electrical signal, are accelerated by a high voltage (1 to 10 KV) applied to a metallic back film 111 and a phosphor film 110, and bombard the phosphor film 110 to make phosphors emit light and display images.

In the above processes, the roles of the metallic back film 111 are to improve brightness by mirror-reflecting a light directing to an inner side among lights emitted from the phosphor toward a face plate 109, to act as an electrode for applying an electron beam accelerating voltage, and to protect the phosphor film 110 from being damaged by bombardment of negative ions generated in the above described sealed vessel.

An ion pump 127 begins operating from an applied voltage of about 1 KV, but when the applied voltage is high, harmful effects of increasing power consumption and needing a reliable measure for insulation increase. For this reason, a preferably used voltage for efficiently driving the ion pump 127 is 2.5 to 5 KV.

When images are displayed, electrons are emitted to make a member in an image display apparatus emit gases. Among these gases, gases such as $H_2$, $O_2$, CO and $CO_2$ which easily damage an electron-emitting device are adsorbed by a getter film 112. On the other hand, Ar of an inert gas is not adsorbed by the getter film 112, but is exhausted by an ion pump 127 that is attached to a rear plate 101, which can control a partial pressure of Ar to $10^{-6}$ Pa that is the pressure for affecting an element, or less, and as a result, inhibits Ar from damaging an element (destroying the element mainly due to sputtering by ionized Ar ions). Accordingly, a provided image display apparatus shows no deterioration of brightness even after having displayed images for a long time, and the long life.

In addition, an ion pump has a configuration in which an ion pump chamber 120 is directly joined to a rear plate 101 with frit glass 125 and a magnet 121 is held with a yoke 122, and accordingly makes an image display apparatus thin and lightweight. In addition, the magnet 121 and the yoke 122 are easily attached and detached, and accordingly can be recycled. Furthermore, even when discharge has occurred in the ion pump chamber 120, a grounded yoke 122 shields harmful electromagnetic waves and reduces a leak of a magnetic field, so that the image display apparatus can display high-definition images.

An ion pump not only joined to a rear plate 101 but also to a face plate 109 shows a similar effect.

An image display apparatus according to the present invention can be applied to the image display apparatus which employs a field emission type electron-emitting device and a simple matrix type electron-emitting device, other than a surface conduction type electron-emitting device for the above described electron source, and which displays images by controlling an electron beam emitted from an electron source with the use of a controlling electrode (grid electrode wiring).

EXAMPLES

The present invention will be specifically explained hereafter with reference to examples.

Example 1

An image display apparatus having an ion pump will be explained referring to FIG. 1, and the configuration and the production method of a vacuum chamber as the image display apparatus referring to FIGS. 3 to 7.

First of all, a method for producing an image display apparatus of a sealed vessel will be described. Soda glass (SL: product made by Nippon Sheet Glass Co., Ltd.) with a thickness of 2.8 mm and a size of 190×270 mm was used as a face plate 109, and the same soda glass with a thickness of 2.8 mm and a size of 240×320 mm was used as a rear plate 101. In the practically used rear plate 101, an outlet 107 with a diameter of 8 mm was opened at a position outside an image region and on the inside of a glass frame 105.

The film of element electrodes 402 and 403 in a surface conduction type electron-emitting device 104 which is an electron source was formed by forming a film of platinum on a rear plate 101 with a vapor deposition method, and processing the film into a shape having a film thickness of 100 nm, the space between electrodes L of 2 μm and an element electrode length W of 300 μm, with a photolithographic technology (including a processing technology such as an etching technique and a lift-off technique).

Subsequently, upper wiring 102 (100 lines) with a width of 500 μm and a thickness of 12 μm and lower wiring 103 (600 pieces) with a width of 300 μm and a thickness of 8 μm were formed on a rear plate 101 each by printing and baking an Ag paste ink. A leading terminal to an external driving circuit was similarly produced. An interlayer insulating layer 401 was formed into a thickness of 20 μm by printing and baking a glass paste (at a baking temperature of 550° C.).

Subsequently, the above described rear plate 101 was cleaned, and then a solution of DDS (dimethyl diethoxy silane, a product made by Shin-Etsu Chemical Co., Ltd.) diluted by ethyl alcohol) was sprayed with a spraying method, and was heated and dried at 120° C. An electroconductive thin film 405 of a fine particle film consisting of PdO (palladium oxides) particles was formed into a diameter of 60 μm on the rear plate and element electrodes by dissolving 15 wt. % palladium-proline complex in an aqueous solution consisting of 85% water and 15% isopropyl alcohol, and applying a thus prepared organopalladium-containing solution with an ink-jet coating applicator, and heating it at 350° C. for 10 minutes.

Subsequently, a supporting frame 105 was prepared so as to acquire a shape with a thickness of 2 mm, outer dimensions of 150×230 mm, and a width of 10 mm, by using soda glass (SL, a product made by Nippon Sheet Glass Co., Ltd.) as a material. The supporting frame 105 was joined to the above described rear plate 101 by installing the supporting frame 105 and sheet-shaped frit glass 106 which has the same shape as the supporting frame 105 and is named as LS7305 (a product made by Nippon Electric Glass Corporation), on a position of the rear plate 101 to be joined, installing it in a clean oven in such a state that a load of 1 g/mm$^2$ was applied onto the supporting frame 105, and heating it at 430° C. for 30 minutes. Simultaneously, a high-voltage terminal was joined to the rear plate 101 in the same way as the supporting frame 105 was.

A rear plate 101 produced in the above described way was subjected to the following forming treatment and activating treatment using an evacuating device shown in FIG. 5. At first, as shown in FIG. 5, a region except a leading electrode (not shown) of the rear plate 101 installed on a substrate stage 503 was sealed with an O-shaped ring 502, and the region in the O-shaped ring was covered with a vacuum chamber 501. The substrate stage 503 has an electrostatic chuck 504 for fixing the rear plate 101 on the stage. Then, a voltage of 1 KV was applied between an ITO film 510 formed on the back surface of the rear plate 101 and an electrode in the electrostatic chuck, and the rear plate 101 was chucked.

Subsequently, air was exhausted from the inside of a vacuum chamber with a magnetic levitation type turbo molecular pump 505, and the rear plate was subjected to the steps after a foaming step in the following way.

At first, air was exhausted from the inside of a vacuum chamber till the pressure reaches $10^{-4}$ Pa, pulse voltage having a rectangular waveform with a width of 1 msec and a voltage of 12 V was applied to upper wiring 102 sequentially at a scroll frequency of 10 Hz. In addition, lower wiring 103 was grounded. A mixed gas of hydrogen and nitrogen (2% $H_2$ and 98% $N_2$) was introduced into a vacuum chamber, and the pressure was kept to 1,000 Pa. A gas introduction rate was controlled by a mass flow controller 508, whereas an exhaust flow rate from the vacuum chamber was controlled by an exhaust system and a conductance valve 507 for controlling a flow rate. When a value of an electric current passing through an electroconductive thin film 405 reached approximately zero, the application of a voltage was stopped. The forming treatment was finished when the mixed gas of H2 and N2 in the vacuum chamber was exhausted, then a crack was formed in every electroconductive thin film 405 on the rear plate 101, and thus an electron-emitting portion 404 was prepared.

Subsequently, all elements on the rear plate 101 were activated by the activation steps of: evacuating the inside of a vacuum chamber 501 to $10^{-5}$ Pa; introducing tolunitrile (molecular weight: 117) into the vacuum chamber till the partial pressure of tolunitrile reaches $1\times10^{-4}$ Pa; and applying a bipolar voltage of a rectangular waveform to upper wiring 102 while dividing the applying time to the wiring (scrolling) into 10 lines, which had a crest value of ±14V and a pulse width of 1 msec.

After activation steps had been finished, tolunitrile remaining in a vacuum chamber 501 was exhausted, the vacuum chamber 501 was returned to an ambient pressure, and a rear plate 101 was taken out.

An ion pump has a cylindrical anode 114 and a cathode 115 each made of SUS, and the center of the cathode 115 is connected to a Ti electrode 116. A bipolar type sputter ion pump used in the present example had a configuration of having the above components arranged in an ion pump chamber 120 made of glass, and an anode connecting terminal 117 and a cathode connecting terminal 118, which are respectively connected to the anode 114 and the cathode 115, arranged outside the ion pump chamber 120. The ion pump chamber 120 was formed by using a soda lime glass molded into such a size (W30 mm×D30 mm×H30 mm) as to house the above described anode 114 and the above described cathode 115. The above described anode connecting terminal 117 and the cathode connecting terminal 118, which are made of a Dumet wire, were arranged by applying frit glass named as ASF1304 (a product made by Asahi Glass Corporation) in a lead opening of the ion pump chamber 120, and heating and baking it at 450° C. for 30 minutes. Then, a leak in the ion pump chamber was checked with a He leak detector to have shown a value of $10^{-12}$ Pa-m$^3$/sec or less which is a detection limit.

Next, a paste consisting of frit glass named as VS-2 (a product made by Nippon Electric Glass Corporation) and an organic binder was applied on the faces (four sides) of an ion pump chamber 120 to be joined to a rear plate 101, with a dispenser. The paste was heated at 400° C. for 30 minutes for the purpose of temporary baking, and further was degassed through degassing treatment of baking itself at 480° C. under a reduced pressure. After the ion pump chamber 120 had returned to room temperature, a leak was checked with a He leak detector to have shown a value of $10^{-12}$ Pa m$^3$/sec or less which is a detection limit.

Subsequently, an anode 114 was connected to an anode connecting terminal 117 and a cathode 115 to a cathode terminal 118 by welding each with a YAG laser. Then, a leak in the ion pump chamber was checked with a He leak detector to have shown a value of $10^{-12}$ Pa·m$^3$/sec or less which is a detection limit.

Then, an ion pump chamber 120 of which the four sides had been coated with frit glass 125 was placed on the surface around an exhaust port 107 of a rear plate 101 which had been placed on a support in a vacuum baking furnace. A weight was placed on the support in a state of pressing the ion pump chamber 120 on the support. A weight of the weight was determined so as to be 0.5 g/mm$^2$ on the face to be joined by frit glass 125.

A vacuum baking furnace was evacuated into a reduced pressure of $10^{-4}$ Pa, was heated to 390° C. and held for 80 minutes. After the vacuum baking furnace returned to room temperature, it was returned to ambient pressure, and a rear plate 101 was taken out.

Subsequently, indium was applied on a supporting frame 105, and a spacer 113 was installed on upper wiring 102 at the spacing of every 20 lines. The spacer 113 was bonded to and fixed on an insulating base provided outside an image display area, with aron ceramic W (a product made by Toagosei Co., Ltd.).

On the other hand, on a face plate 109, a phosphor film 110 was formed so that each phosphor (R, G, B) in a stripe form was alternately separated by a black electroconductive material (black stripe), and then a metallic back film 111 made of an aluminum thin film was formed thereon to have a thickness of 200 nm. Subsequently, indium 108 was applied onto a silver paste pattern which had been previously provided on the periphery of the face plate 109.

A rear plate 101 to which the above described supporting frame 105 and an ion pump chamber 120 are joined, and a face plate 109 were set on a transportation holder 604, and was charged into a load chamber 602 with ambient pressure, through an exporting and importing port 601 of a vacuum treatment apparatus shown in FIG. 6, which had been opened. The exporting and importing port 601 was closed, the pressure of the load chamber 602 was reduced to about $3\times10^{-5}$ Pa, a gate valve 605 was opened, the transportation holder 604 was imported into a vacuum treatment chamber 603 of which the pressure had been previously reduced to about $1\times10^{-5}$ Pa with evacuating means 2 shown by reference numeral 607, and the gate valve 605 was closed. After the transportation holder 604 was fit into a predetermined position, as shown in FIG. 7, the rear plate 101 was tightly contacted with an upper hot plate 706 and the face plate 109 with a lower hot plate 707, and they were heated at 300° C. for one hour.

Subsequently, a rear plate 101 and one part of a transportation holder 604 supporting it were moved upward together with an upper hot plate 706 by about 30 cm. Then, one lid-shaped holder 703 was inserted into a space between the rear plate 101 and the face plate 109, and was placed on a face plate 109. The barium film of 50 nm thick was formed on a metallic back film 111 on the face plate 109, by sequentially applying an electric current of 12 amperes by every 10 seconds to a container which contains a barium getter and was installed on a ceiling of an inner side of the lid-shaped holder 703. The lid-shaped holder 703 was returned to the previous position, and the other lid-shaped holder 703 was similarly operated.

Next, a lid-shaped holder 703 was returned to its original position; a rear plate 101, a supporting tool which is one part of a transportation holder 604, and an upper hot plate 706 were moved down; and the upper hot plate 706 and a lower hot plate 707 were heated to 180° C. After having had been held at 180° C. for three hours, the rear plate 101, the supporting tool which is one part of the transportation holder 604, and the upper hot plate 706 were further moved down, and a load of 60 kg/cm$^2$ was applied to the rear plate 101, the face plate 109 and a supporting frame 105. Heating was stopped in the state, they were self-cooled to room temperature, and seal bonding was completed.

A gate valve 605 was opened, a vacuum chamber was exported from a vacuum treatment chamber 603 to a load chamber 602, the gate valve 605 was closed, the pressure of the load chamber 602 was returned to ambient pressure, and a sealed vessel was exported from an exporting and importing port 601. The sealed vessel produced as described above did not show any crack or fracture at all.

Subsequently, a supporting plate 123 made of an acryl resin was bonded to a rear plate by applying a two-liquid cure type epoxy adhesive named as EP001 (a product made by Cemedine Corporation) to the periphery of an ion pump chamber 120, and placing a weight of 300 g on the supporting plate 123 to cure the adhesive. In the supporting plate 123, four screw holes were opened so as to fix a yoke 122 made of a permalloy. At the same time, a leaf spring 119 made of phosphor bronze was bonded to the predetermined position of the ion pump chamber 120 by the same adhesive, which was cured; and subsequently, was connected with an In solder so as to be communicated with a cathode connecting terminal 118. Next, a magnet 121 was attached to a predetermined position inside the yoke 122, a grounding conductor 126 was attached to the yoke 122 with a screw, and the yoke 122 was fixed with screws to the supporting plate so that a magnetic field can become maximum in the center of an ion pump, while measuring a magnetic field with a gauss meter and adjusting the position of the magnet 121. The conduction between the grounding conductor 126 and the cathode connecting terminal 118 was confirmed with a circuit tester. The ion pump 127 was produced in the above described steps.

Next, an image display apparatus having an ion pump 127 was assembled by the steps of: connecting a sealed vessel to a voltage-applying device and a high-voltage-applying device with a cable so that the sealed vessel can display images; and further connecting a cathode connecting terminal 118 and an anode connecting terminal 117 of an ion pump 127 to an ion pump power source with wires.

Then, a voltage of 5 KV was applied to an ion pump power source, and an ion pump 127 was driven with a magnetic field of 1,400 G or more in a center of the ion pump. In addition, picture signals having the conditions of 16.7 μsec, 60 Hz and 15 V were supplied to an electron-emitting device from a voltage-applying device connected to an image display apparatus, at the same time a high voltage of 10 KV was applied by a high-voltage-applying device to make a surface conduction type electron-emitting device 104 emit light, and the image display apparatus displayed images.

In order to evaluate the life of an image display apparatus, the image display apparatus was made to continuously display images, and the period of time before brightness was lowered to the half of that at the starting time was measured to have shown 15,000 hours.

In addition, when an impact resistance test was conducted as a reliability test, five panels among ten panels of a comparative example (FIG. 9) showed a leak, and could no longer display images, whereas no panel in the present example showed a leak. The impact resistance test described above is a drop impact test based on JISC0041, and was continuously conducted three times in each direction in conditions of a room temperature (23±5° C. and 50 to 70% RH), a pulse with a sinusoidal half wave form, an accelerated velocity of 50 G, an action time of 11 ms and accelerating directions of six directions.

In addition, an image display apparatus after having been packed in a panel vessel showed about 100 mm thinner thickness than a comparative example (FIG. 9) showed.

In addition, when having made image display apparatuses display images, the image display apparatus in a comparative example (FIG. 9) showed a picture of deteriorated quality due to the effects of noises generated by discharge in an ion pump and the magnetic field of a magnet, whereas the image display apparatus according to the present invention showed a picture free from the effects of the noises and the magnetic field.

An image display apparatus produced in the present example has an ion pump accommodated in a glass housing which is joined to the rear surface of a rear plate with frit; accordingly does not produce leaks, is small, thin, lightweight and inexpensive, and has high reliability; and besides, has the long life because the ion pump is easily attached.

Example 2

In Example 2, an image display apparatus having an ion pump 127 was prepared similarly to Example 1 except that a coiled spring 201 was used as a spring for connecting a cathode connecting terminal 118 to an ion pump chamber 120.

Subsequently, an image display apparatus was assembled by the steps of: connecting a sealed vessel to a voltage-applying device and a high-voltage-applying device with a cable so that the sealed vessel can display images; and further connecting a cathode connecting terminal 118 and an anode connecting terminal 117 of an ion pump 127 to an ion pump power source with wires.

Then, the voltage of 5 KV was applied to an ion pump power source, and an ion pump 127 was driven with a magnetic field of 1,400 G or more in a center of the ion pump. In addition, picture signals having the conditions of 16.7 μsec, 60 Hz and 15 V were supplied to an electron-emitting device from a voltage-applying device connected to an image display apparatus, at the same time a high voltage of 10 KV was applied by a high-voltage-applying device to make a surface conduction type electron-emitting device 104 emit light, and the image display apparatus displayed images.

In order to evaluate the life of an image display apparatus, the image display apparatus was made to continuously display images, and the period of time before brightness was lowered to the half of that at the starting time was measured to have shown 15,000 hours.

In addition, when an impact resistance test was conducted as a reliability test, five panels among ten panels of a comparative example (FIG. 9) showed a leak, and could no longer display images, whereas any panel in the present example did not show the leak. In addition, an image display apparatus after having had been packed in a vessel showed about 100 mm thinner thickness than a comparative example (FIG. 9) showed.

In addition, when having made image display apparatuses display images, the image display apparatus in a comparative example (FIG. 9) showed a picture of deteriorated quality due to the effects of noises generated by discharge in an ion pump and the magnetic field of a magnet, whereas the image display apparatus according to the present invention showed a picture free from the effects of the noises and the magnetic field.

An image display apparatus produced in the present example has an ion pump accommodated in a glass housing which is joined to the rear surface of a rear plate with frit; accordingly does not produce leaks, is small, thin, lightweight and inexpensive, and has high reliability; and besides, has the long life because the ion pump is easily attached.

Example 3

Figure 8:
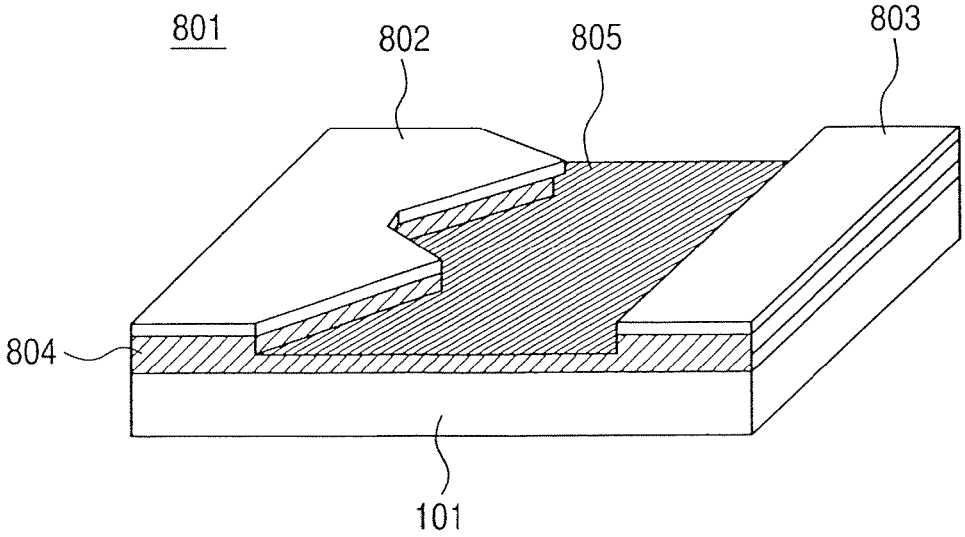
FIG. 8 is a schematic view showing a configuration of a field emission type electron-emitting device to which the present invention is applied.

In an Example 3, an image display apparatus using a field emission type electron-emitting device as an electron source will be described. FIG. 8 shows a structure of the field emission type electron-emitting device 801 used in the present example. In the figure, reference numeral 802 denotes a negative electrode, reference numeral 803 a positive electrode, reference numeral 805 an electron-emitting portion for emitting electrons, of which the tip is formed into an acute angle, and reference numeral 804 an insulating layer. In such a configuration, when voltage is applied to the positive electrode 803 and the negative electrode 802 so that the positive electrode 803 can have a high potential, an electric field is concentrated in the electron-emitting portion 805 and the electrons are emitted from the electron-emitting portion 805 by a tunnel effect.

A method for producing an image display apparatus in the present example will be described below. At first, a field emission type electron-emitting device 801 was produced on a rear plate 101 with the use of the same rear plate 101 as in Example 1. A negative electrode 802 and a positive electrode 803 were formed into a thickness of 0.3 μm by using Mo; 100 electron-emitting portions 805 were produced in any electron source corresponding to one pixel so that each tip angle of the electron-emitting portions 805 could be 45 degrees; and an insulating layer 804 was formed into a thickness of 1 μm by using $SiO_2$. Each of the above films was formed by depositing Mo or $SiO_2$ with a sputtering method, and processing the deposited film with a photolithographic technology (including a processing technology such as an etching technique and a lift-off technique). Subsequently, upper wiring 102 and lower wiring 103 were formed so as to possess the same structure and member as in Example 1, with the same method as in Example 1. In addition, the lower wiring 103 was electrically contacted with one part of the positive electrode 803, and the upper wiring 102 with one part of the negative electrode 802. Furthermore, the rear plate 101 and the face plate 109 were formed with the use of the same structure and member and with the same method as in Example 1.

After the above steps, an image display apparatus having an ion pump was produced with the same method as in Example 1. The voltage of 5 KV was applied to an ion pump power source of the image display apparatus which had been produced as described above to drive the ion pump 127 while generating a magnetic field of 1,400 G or higher in the center of the ion pump. In addition, picture signals having the conditions of 16.7 μsec, 60 Hz and 15 V were supplied to an electron-emitting device from a voltage-applying device connected to the image display apparatus, at the same time a high voltage of 10 KV was applied by a high-voltage-applying device to make an electron-emitting portion 805 emit light, and the image display apparatus displayed images.

In order to evaluate the life of an image display apparatus, the image display apparatus was made to continuously display images, and the period of time before brightness was lowered to the half of that at the starting time was measured to have shown 15,000 hours.

In addition, when an impact resistance test was conducted as a reliability test, five panels among ten panels of a comparative example (FIG. 9) showed a leak, and could no longer display images, whereas any panel in the present example did not show the leak. In addition, an image display apparatus after having had been packed in a panel housing showed about 100 mm thinner thickness than a comparative example (FIG. 9) showed.

In addition, when having made image display apparatuses display images, the image display apparatus in a comparative example (FIG. 9) showed a picture of deteriorated quality due to the effects of noises generated by discharge in an ion pump and the magnetic field of a magnet, whereas the image display apparatus according to the present invention showed a picture free from the effects of the noises and the magnetic field.

An image display apparatus produced in the present example has an ion pump accommodated in a glass housing which is joined to the rear surface of a rear plate with frit; accordingly does not produce leaks, is small, thin, lightweight and inexpensive, and has high reliability; and besides, has the long life because the ion pump is easily attached.

As described above, an ion pump according to the present invention is joined to a substrate with frit in a simple configuration, has the magnet of the ion pump installed in a removable yoke, and consequently does not receive an excessive force, so that an image display apparatus produced does not produce a leak, is lightweight and thin, and has high reliability.

Furthermore, when an ion pump is grounded through a yoke, it does not generate noises due to a discharge of the ion pump, and does not exert an influence upon images by a magnetic field because the yoke shields the magnetic field, so that an image display apparatus which displays high-definition images can be produced.

In addition, an ion pump can easily exhaust a released gas which is hardly adsorbed by a getter film, consequently can protect an electron source from being deteriorated by the released gas generated while images are displayed, and accordingly greatly extend the life of an image display apparatus.

Thus, an image display apparatus which is thin, displays high-definition images, and has the long life and high reliability can be produced by using a configuration of an image display apparatus according to the present invention.

This application claims priority from Japanese Patent Application No. 2004-248539 filed Aug. 27, 2004, which is hereby incorporated by reference herein.

What is claimed is:

1. An image display apparatus comprising:

a vacuum chamber comprising an electron source substrate having a plurality of electron-emitting devices arranged thereon, and an image forming substrate which is arranged so as to face the electron source substrate, and has a phosphor film and an anode; and an ion pump having an ion pump chamber, an anode and a cathode accommodated in the ion pump chamber, wherein the ion pump chamber is joined with frit glass to an aperture portion formed in the electron source substrate or the image forming substrate, a supporting member for supporting a holding portion is bonded with a bonding adhesive on a substrate to which the ion pump chamber is joined, so as to surround the ion pump chamber, and a magnet is attached to the holding portion on which the magnet is located outside the ion pump chamber, and wherein the holding portion and the magnet attached to the holding portion are detachable from said supporting member.

2. The image display apparatus according to claim 1, wherein the holding portion is connected to a cathode connecting terminal of the ion pump, and the holding portion is also grounded.

3. The image display apparatus according to claim 2, wherein the holding portion is connected to a cathode connecting terminal of the ion pump with a spring.

* * * * *